US008127568B2

(12) United States Patent
Sobchenko

(10) Patent No.: US 8,127,568 B2
(45) Date of Patent: Mar. 6, 2012

(54) ARTICLE OF JEWELRY AND METHOD OF MANUFACTURE

(76) Inventor: Dimitriy Sobchenko, New Hyde Park, NY (US)

( * ) Notice: Subject to any disclaimer, the term of this patent is extended or adjusted under 35 U.S.C. 154(b) by 953 days.

(21) Appl. No.: 12/127,754

(22) Filed: May 27, 2008

(65) Prior Publication Data

US 2009/0293543 A1 Dec. 3, 2009

(51) Int. Cl.
*A44C 17/02* (2006.01)

(52) U.S. Cl. ..... 63/26; 29/10; 428/542.2

(58) Field of Classification Search ..... None
See application file for complete search history.

(56) References Cited

U.S. PATENT DOCUMENTS 521,670 A * 6/1894 Hensel ..... 293/40
3,479,199 A * 11/1969 Boucher ..... 427/201

* cited by examiner

*Primary Examiner* — Jack W. Lavinder
(74) *Attorney, Agent, or Firm* — Jennifer Meredith, Esq.; Meredith & Keyhani, PLLC

(57) ABSTRACT

An article of jewelry comprising: a first base having an outer surface and at least two wells; a layer of adhesive material in communication with at least one well; a layer of glitter in communication with at least a portion of the adhesive material in at least one well to provide a glitter adhesive filled well; at least one gemstone in communication with the layer of adhesive material and at least partially contained in at least one well; and at least one circular surrounding piece having an outer circumference and a center opening, the center opening corresponding to and surrounding the gemstone and in communication with the layer of adhesive material.

21 Claims, 9 Drawing Sheets

ARTICLE OF JEWELRY AND METHOD OF MANUFACTURE

The present invention relates to an article of jewelry that has decorative elements on an outer surface and a method of manufacturing the article of jewelry.

Diamonds and gemstones are highly demanded and desirable within jewelry. However, they are also expensive. Because of this, any way to make diamonds and gemstones appear larger or more plentiful are desirable.

The present invention combines precious or semi-precious gemstones with a decorative element having a similar appearance to the precious or semi-precious gemstones to give the appearance that the decorative element is also a precious or semi-precious gemstone.

These and other features, aspects and advantages of the present invention will become better understood with reference to the following description and claims.

SUMMARY OF THE INVENTION

The present invention relates generally to a jewelry and related methods of manufacture.

According to one embodiment of the present invention, an article of jewelry comprising: a first base having an outer surface and at least one well; a layer of adhesive material in communication with the at least one well; at least one gemstone in communication with the layer of adhesive material and at least partially contained in the at least one well; and at least one circular surrounding piece having an outer circumference and a center opening, the center opening corresponding to and surrounding the gemstone and in communication with the layer of adhesive material.

According to another embodiment of the present invention, an article of jewelry comprising: a first base having an outer surface and at least two wells; a layer of adhesive material in communication with the at least one well; a layer of glitter in communication with at least a portion of the adhesive material in at least one well to provide a glitter adhesive filled well; at least one gemstone in communication with the layer of adhesive material and at least partially contained in the at least one well; and at least one circular surrounding piece having an outer circumference and a center opening, the center opening corresponding to and surrounding the gemstone and in communication with the layer of adhesive material.

According to another embodiment of the present inventions a method of manufacturing an article of jewelry is claimed comprising: providing a first base having an outer surface and at least two wells; filling each well with a layer of adhesive material; providing a layer of glitter in communication with at least a portion of the adhesive material in at least one well to provide a glitter adhesive filled well; placing at least one circular surrounding piece having an outer circumference and a center opening on top of and surrounding each well; providing at least one gemstone in the center opening and in communication with the layer of adhesive material and at least partially contained in the at least one well.

These and other features, aspects and advantages of the present invention will become better understood with reference to the following description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
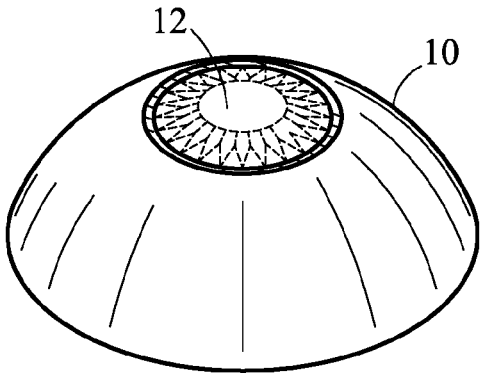
FIG. 1 depicts a top perspective view of a portion of an article of jewelry according to the present invention.
Figure 2:
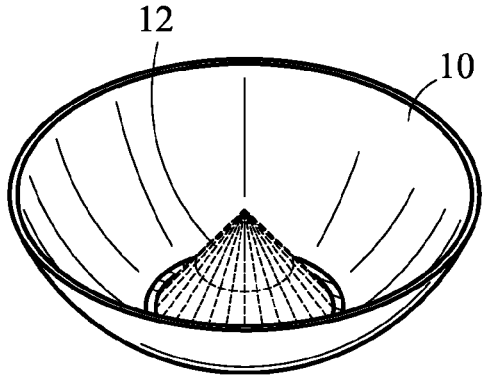
FIG. 2 depicts a bottom perspective view of a portion of an article of jewelry according to the present invention.
Figure 3:
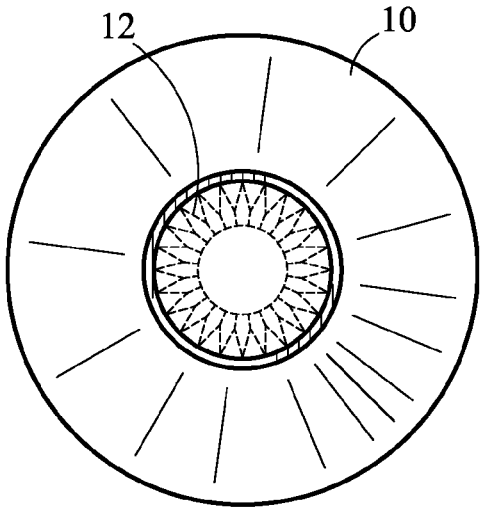
FIG. 3 depicts a top view of a portion of an article of jewelry according to the present invention.
Figure 4:
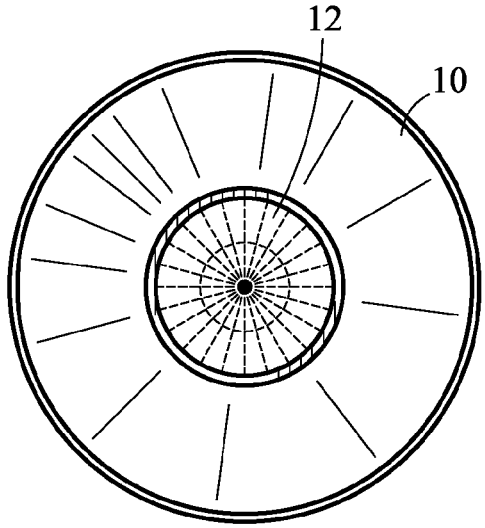
FIG. 4 depicts a bottom view of a portion of an article of jewelry according to the present invention.
Figure 5:
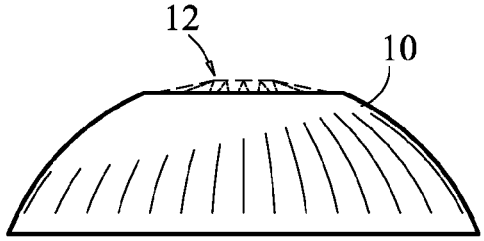
FIG. 5 depicts a side view of a portion of an article of jewelry according to the present invention.
Figure 6:
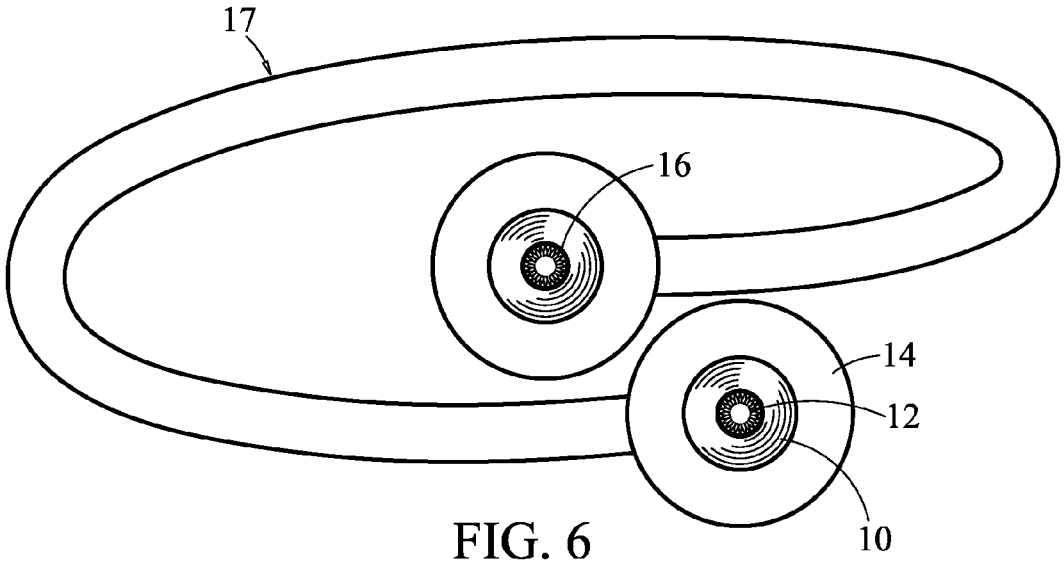
FIG. 6 depicts a top view of an article of jewelry according to the present invention.
Figure 7:
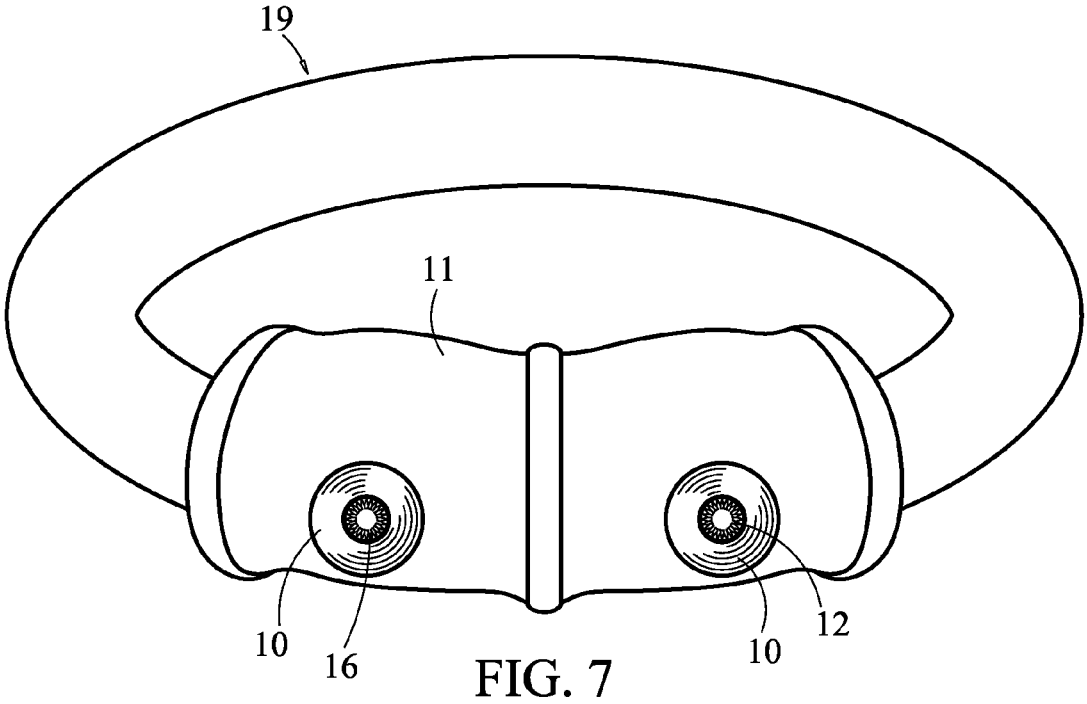
FIG. 7 depicts a top perspective view of an article of jewelry according to the present invention.
Figure 8:
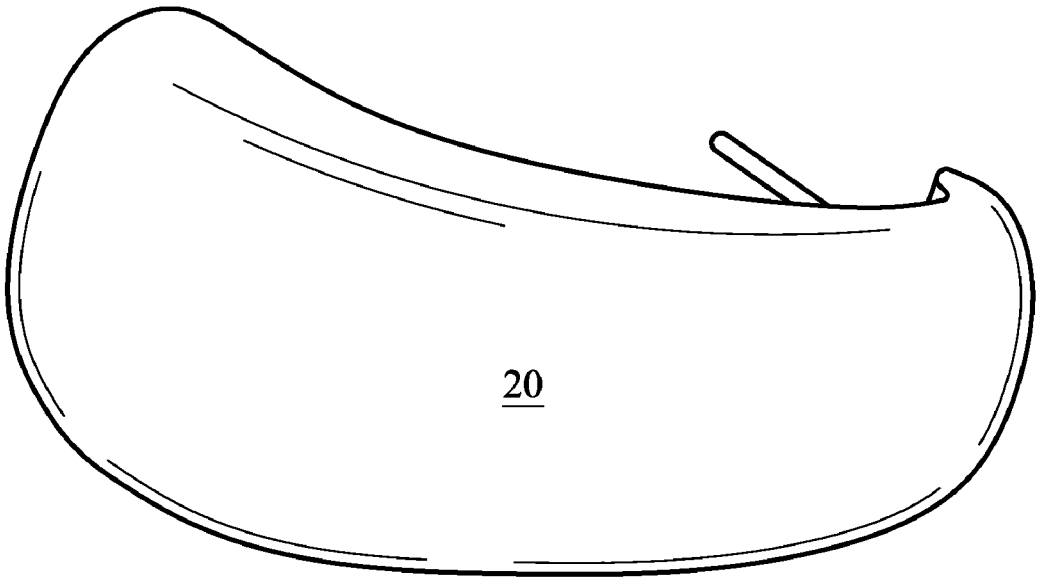
FIG. 8 depicts a top perspective view of an earring base according to the present invention.
Figure 9:
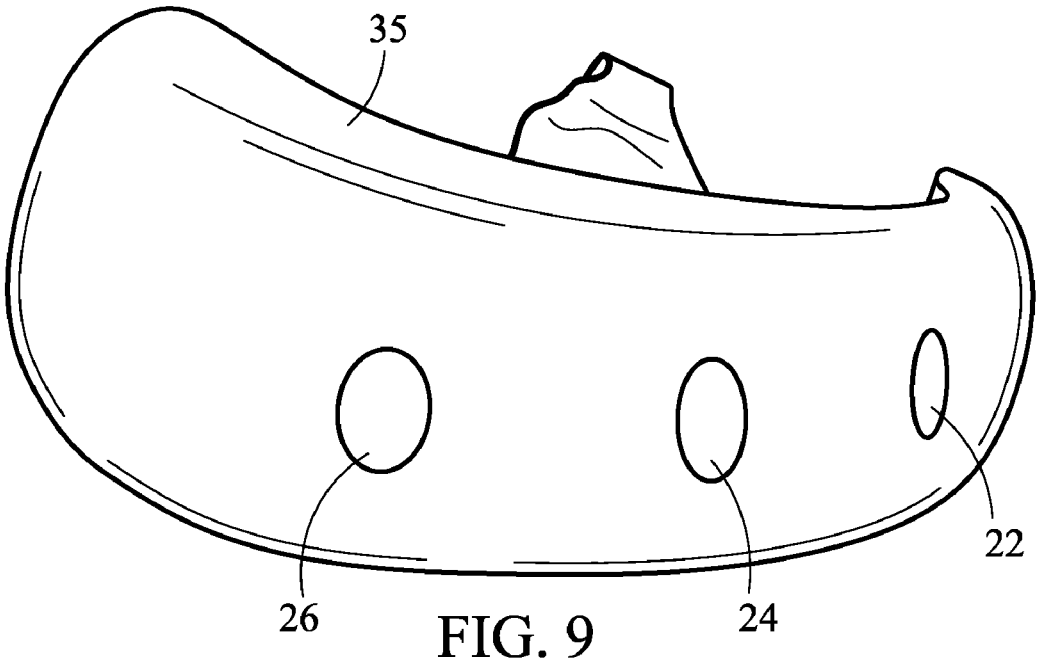
FIG. 9 depicts a top perspective view of an earring according to the present invention.
Figure 10:
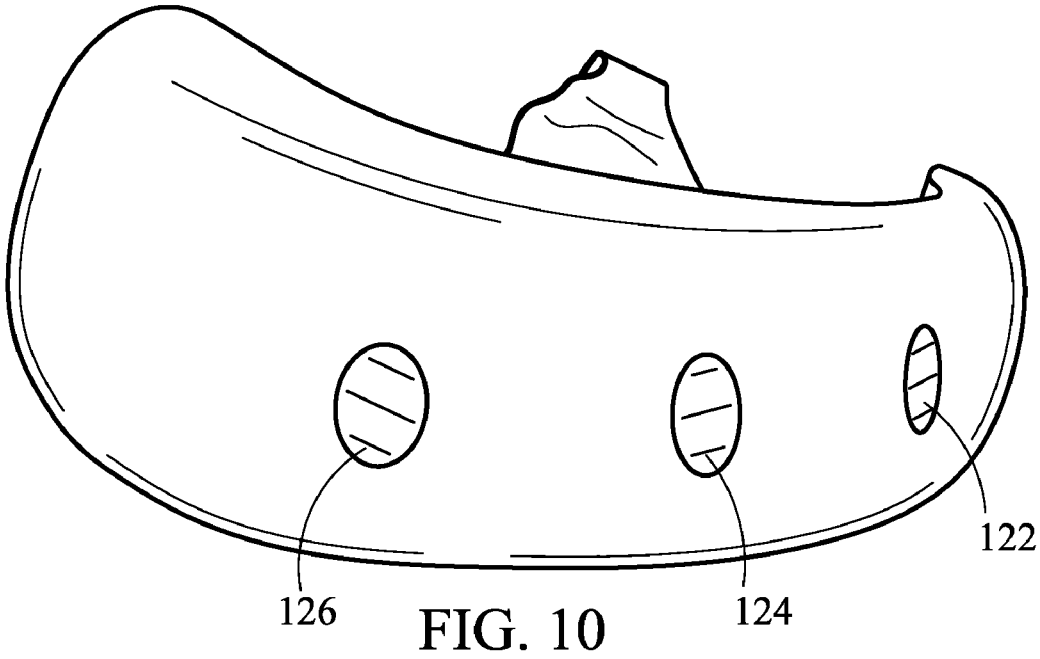
FIG. 10 depicts a top perspective view of an earring according to the present invention.
Figure 11:
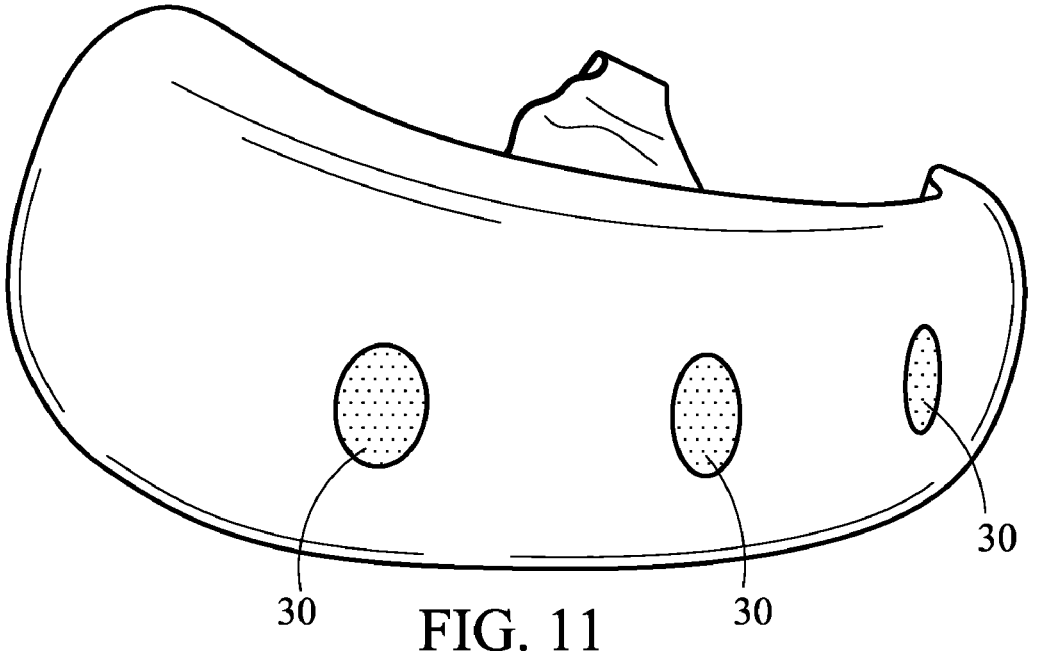
FIG. 11 depicts a top perspective view of an earring according to the present invention.
Figure 12:
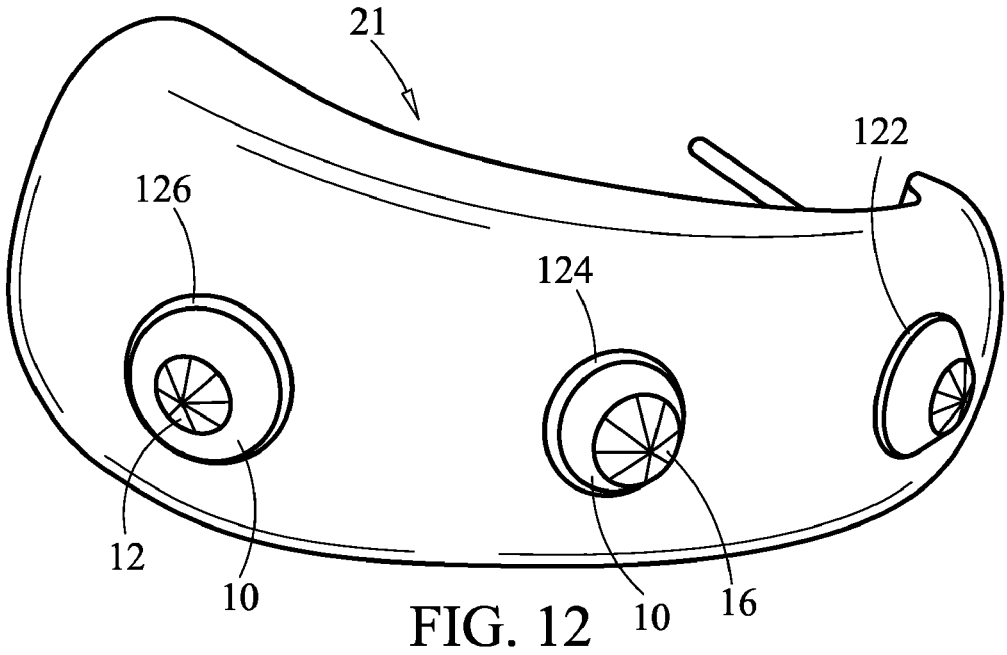
FIG. 12 depicts a top perspective view of an earring according to the present invention.
Figure 13:
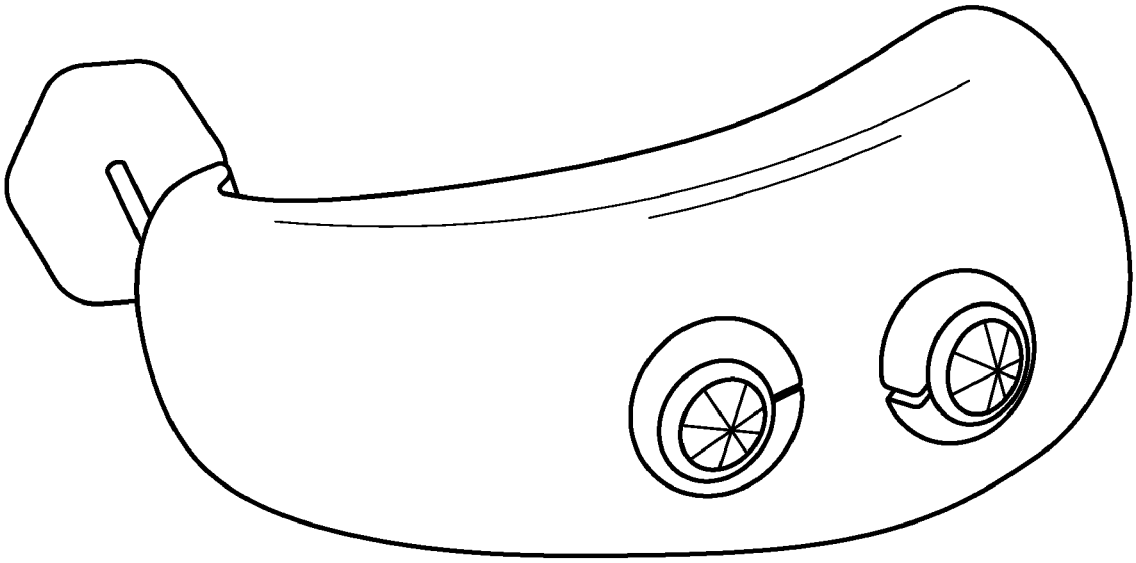
FIG. 13 depicts a top perspective view of an earring according to the present invention.
Figure 14A:
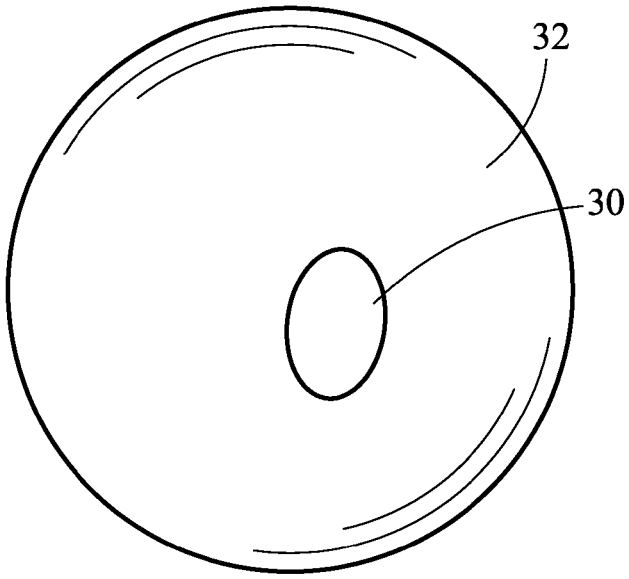
FIGS. 14A-14E depicts different shapes of the well according to one aspect of the present invention, 14F depicts a bottom perspective view of a portion of an article of jewelry according to the present invention.
Figure 14B:
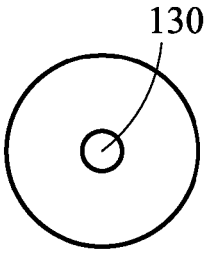
Figure 14C:
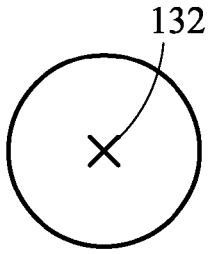
Figure 14D:
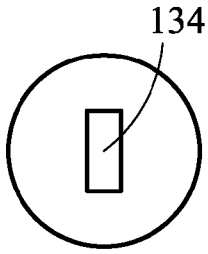
Figure 14E:
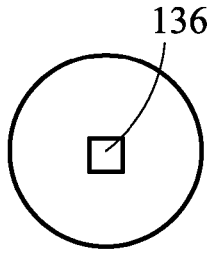
Figure 14F:
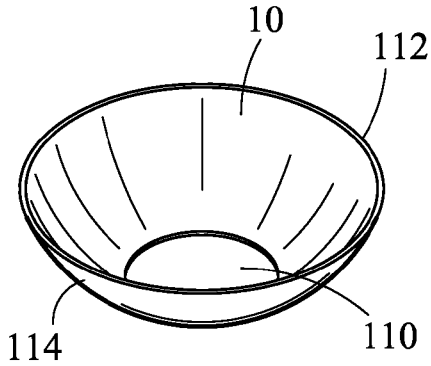

With reference to FIGS. 1-18, an article of jewelry (17, 19, 21) is provided comprising a first base having an outer surface (11, 14, 35) and at least one well (22, 24, 26); a layer of adhesive material (122) 124, 126) in communication with the respective at least one well; optionally a layer of glitter (30) may be sprinkled on top of the layer of adhesive material as shown in FIG. 11. At least one gemstone (e.g. 12) is placed in communication with the layer of adhesive material and at least partially contained in at least one well; and at least one circular surrounding piece (10) having an outer circumference and a center opening is provided the center opening corresponding to and surrounding the gemstone (12) and in communication with the layer of adhesive material (126). One of the advantages of the present invention is that real diamonds may be affixed to tubular bases. FIG. 7-13 are tubular bases in which they are hollow in the center. A tubular base is difficult to include gemstones in.

Figure 15:
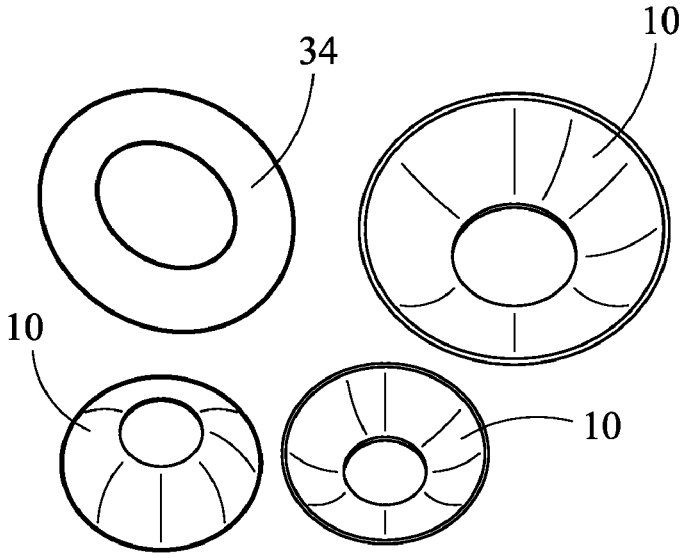
FIG. 15 depicts different circular surrounding pieces according to the present invention.
Figure 16:
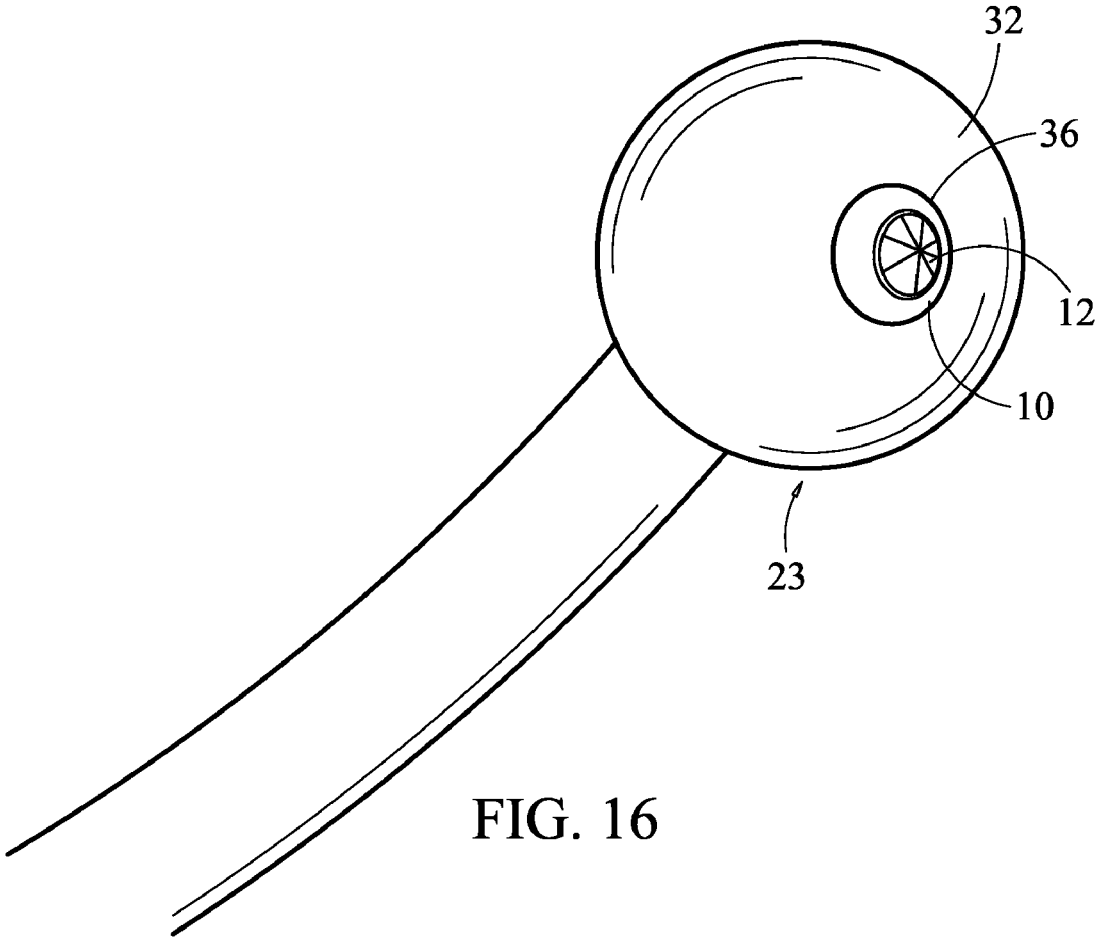
FIG. 16 depicts a top perspective view of a portion of a bracelet according to the present invention.
Figure 17:
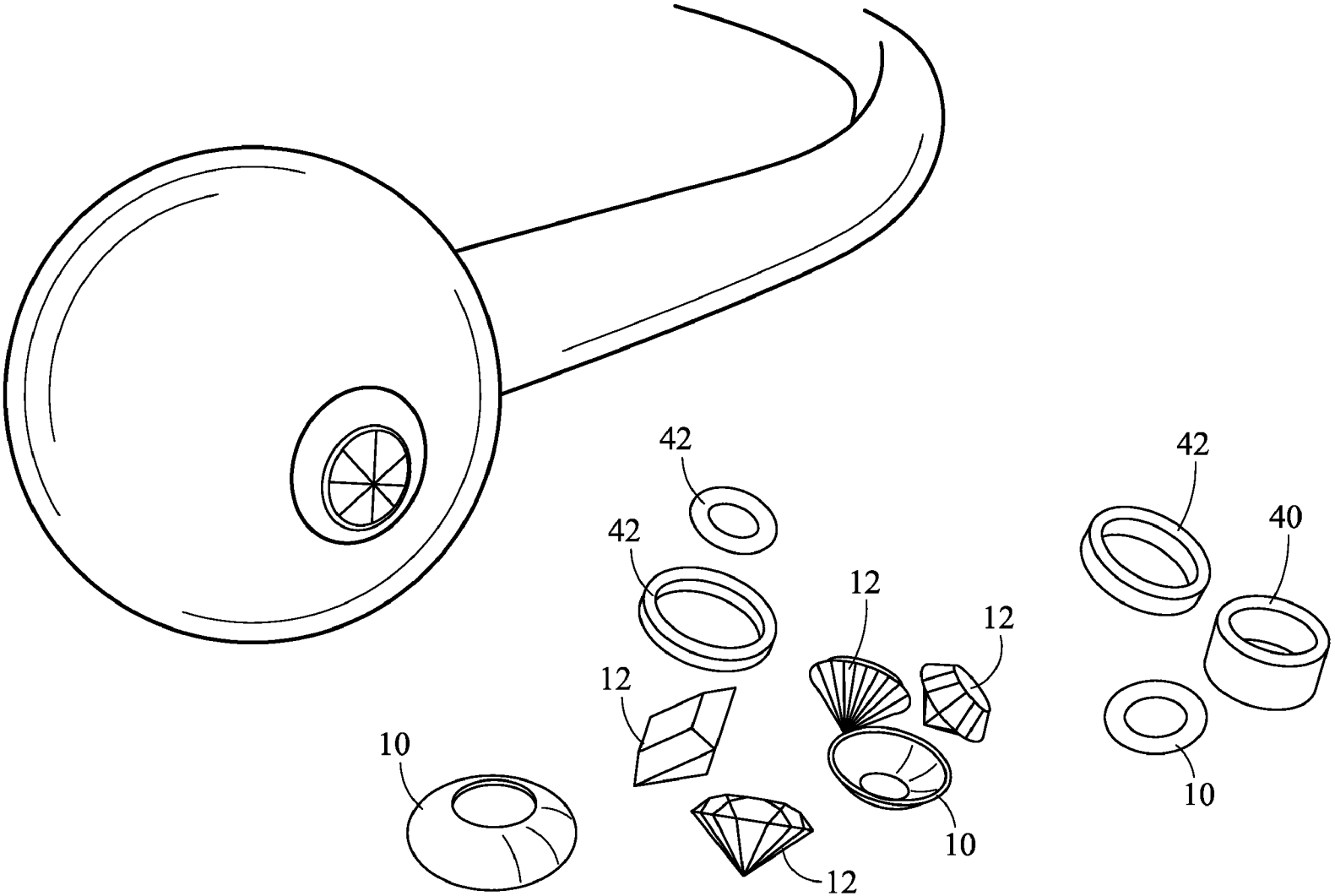
FIG. 17 depicts a top perspective view of different shaped pieces according to the present invention.
Figure 18:
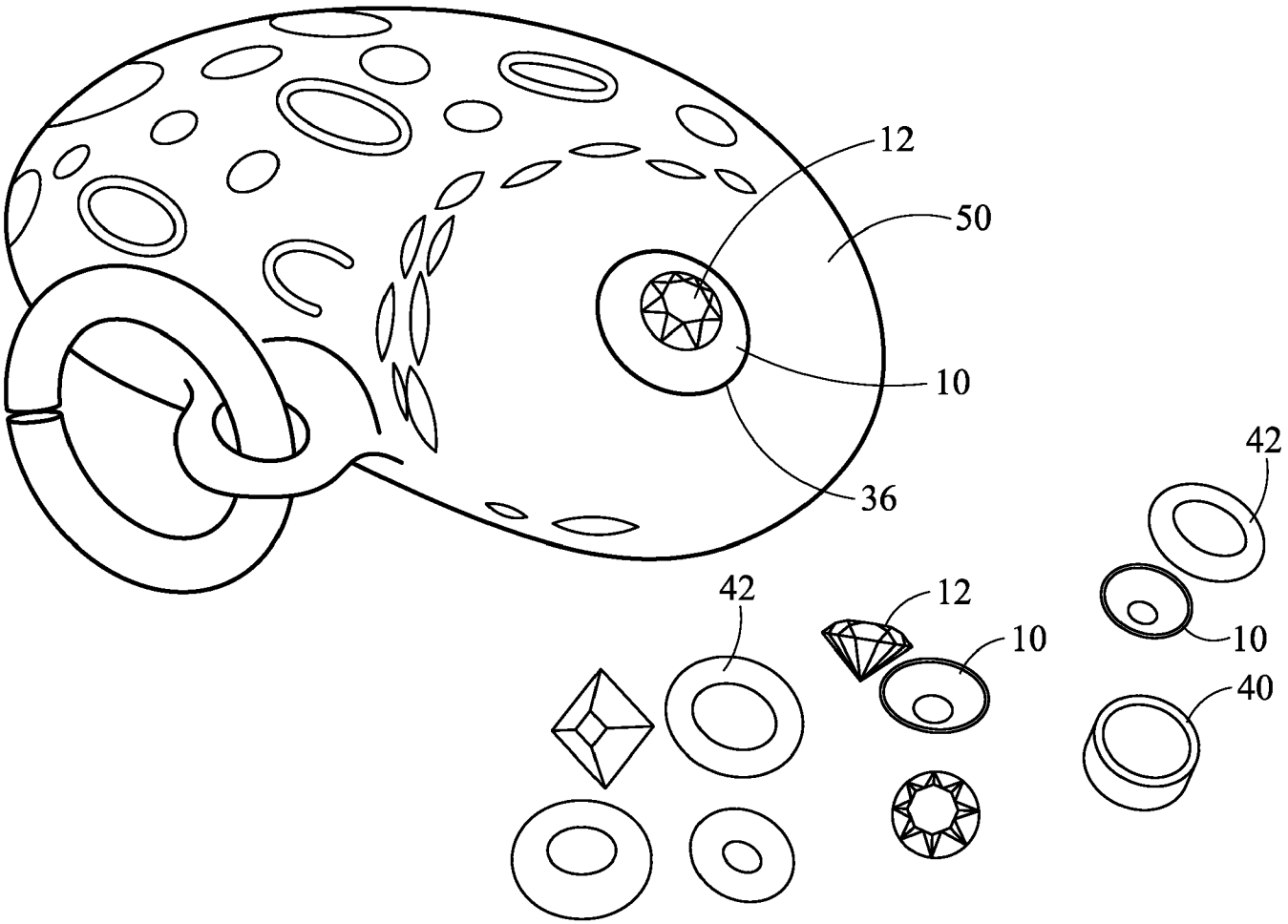
FIG. 18 depicts a top perspective view of different shaped pieces according to the present invention.

The well may be a suitable shape such as oblong shaped (as depicted in FIGS. 14A-14F), round shaped (130), x shaped (132), rectangular shaped (134) and square shaped (136). The at least one circular surrounding piece is raised along the center (114) between the outer circumference (112) and center opening (110). As can be seen in FIG. 14 F, when placed face down on a surface, the outer circumference (112) is higher than the center opening (110) and bevels down towards the center (114) as if it is a top quarter of a globe shape with a center opening (110). FIG. 15 depict different circular surrounding pieces. As can be seen they may be different sizes and shapes. Circular surround piece 34 is round and tubular and 10 is beveled with the outer circumference higher than the center opening (110).

One very important feature of the present invention is that there may be a second well (24) on the first base and a decorative element (16) in communication with the second well (24). There is also at least one circular surrounding piece (10) having an outer circumference and a center opening, the center opening corresponding to and surrounding the decorative element (16). The decorative element (16) is typically a similar size as the at least one gemstone (12) to provide the look that they are the same. The decorative element is selected from the group consisting of gemstone, epoxy, adhesive material and cubic zirconium. The epoxy may be thermally curable colored or colorless epoxy or UV curable epoxy.

There may be a layer of glitter (30) in communication with the adhesive material and the gemstone. Glitter is a product used in crafts to create a sparkling or shimmering effect. Glitter is primarily composed of very tiny flecks of glass, stone, paper or plastic, although polyester is perhaps the most common material used in modern glitter production. Coated paper can also be formed into glitter, and even commercial grade diamond dust as a form of glitter. Even though pieces of glitter can be as small as 50 microns (0.002 inches) in size, each one has been precision-cut in the shape of squares, circles, rectangles or hexagons. According to a preferred embodiment, the 0.004 and 0.20 inches, preferably 0.008 inches.

A method of manufacturing an article of jewelry comprising providing a first base having an outer surface (e.g. 11, 14, 35) and at least two wells (e.g. 22, 24 and 26); The well (e.g. 22, 24 and 26) may be formed by a diamond cutter. Next, the method may comprise the step of filling each well (e.g. 22, 24 and 26) with a layer of adhesive material (e.g. 122, 124 and 126); providing a layer of glitter (30) in communication with at least a portion of the adhesive material (e.g. 122, 124 and 126) in at least one well to provide a glitter adhesive filled well; placing at least one circular surrounding piece having an outer circumference (112) and a center opening (114) on top of and surrounding each well (e.g. 22, 24 and 26); providing at least one gemstone (12) in the center opening and in communication with the layer of adhesive material and at least partially contained in the at least one well. The circular surrounding piece (10) is raised along the center between the outer circumference and center opening. There may be a decorative element in communication with glitter adhesive filled well (30). There may be the step of providing at least one circular surrounding piece having an outer circumference and a center opening, the center opening corresponding to and surrounding the decorative element. The decorative element according to a preferred embodiment is a similar size as the at least one gemstone. The decorative element may be a gemstone, epoxy, adhesive material and cubic zirconium. According to a preferred embodiment, one well contains a precious gemstone (such as a diamond) and another well contains the adhesive material shaped and filled to look similar to the diamond. In this way, the article of jewelry contains real and faux elements. Also; the glitter in the adhesive material gives the appearance of real jewels. In particular, superfine glitter (preferably 0.008 inches) in an adhesive material gives the appearance of a gemstone.

It should be understood that the foregoing relates to preferred embodiments of the invention and that modifications may be made without departing from the spirit and scope of the invention as set forth in the following claims.

I claim:

1. An article of jewelry comprising:

a first base having an outer surface and at least one well;

a layer of adhesive material in communication with said at least one well;

at least one gemstone in communication with said layer of adhesive material and at least partially contained in said at least one well; and at least one circular surrounding piece having a partially hemi-spherical shape with a central aperture formed in the apex and an outer circumference, said central aperture corresponding to and surrounding said gemstone and in communication with said layer of adhesive material, wherein said at least one circular surrounding piece is raised along the outer circumference to the central aperture.

2. An article of jewelry as in claim 1, wherein said well is selected from the group consisting of oblong shaped, round shaped, x shaped, rectangular shaped and square shaped.

3. An article of jewelry as in claim 1, further comprising:

a second well on said first base;

a decorative element in communication with said second well;

at least one circular surrounding piece having a partially hemi-spherical shape with a central aperture formed in the apex and an outer circumference, said central aperture corresponding to and surrounding said decorative element.

4. An article of jewelry as in claim 3, wherein said decorative element is a similar size as said at least one gemstone.

5. An article of jewelry as in claim 3, wherein said decorative element is selected from the group consisting of gemstone, epoxy, adhesive material and cubic zirconium.

6. An article of jewelry as in claim 1, further comprising a layer of glitter in communication with said adhesive material and said gemstone.

7. An article of jewelry as in claim 6, wherein said glitter has a particle size between 0.004 and 0.20 inches, preferably 0.008 inches.

8. An article of jewelry comprising:

a first base having an outer surface and at least two wells;

a layer of adhesive material in communication with said at least one well;

a layer of glitter in communication with at least a portion of the adhesive material in at least one well to provide a glitter adhesive filled well;

at least one gemstone in communication with said layer of adhesive material and at least partially contained in said at least one well; and at least one circular surrounding piece having a partially hemi-spherical shape with a central aperture formed in the apex and an outer circumference, said central aperture corresponding to and surrounding said gemstone and in communication with said layer of adhesive material.

9. An article of jewelry as in claim 8, wherein said well is selected from the group consisting of oblong shaped, round shaped, x shaped, rectangular shaped and square shaped.

10. An article of jewelry as in claim 8, wherein said at least one circular surrounding piece is raised along the outer circumference to the central aperture.

11. An article of jewelry as in claim 8, further comprising:

a decorative element in communication with said glitter adhesive filled well;

at least one circular surrounding piece having a partially hemi-spherical shape with a central aperture formed in the apex and an outer circumference, said central aperture corresponding to and surrounding said decorative element.

12. An article of jewelry as in claim 11, wherein said decorative element is a similar size as said at least one gemstone.

13. An article of jewelry as in claim 11, wherein said decorative element is selected from the group consisting of gemstone, epoxy, adhesive material and cubic zirconium.

14. An article of jewelry as in claim 8, wherein said glitter has a particle size between 0.004 and 0.20 inches, preferably 0.008 inches.

15. A method of manufacturing an article of jewelry comprising:

providing a first base having an outer surface and at least two wells;

filling each said well with a layer of adhesive material;

providing a layer of glitter in communication with at least a portion of the adhesive material in at least one well to provide a glitter adhesive filled well;

placing at least one circular surrounding piece having a partially hemi-spherical shape with a central aperture formed in the apex and an outer circumference on top of and surrounding each said well;

providing at least one gemstone in said central aperture and in communication with said layer of adhesive material and at least partially contained in said at least one well.

16. An article of jewelry as in claim 15, wherein said well is formed by a diamond cutter.

17. An article of jewelry as in claim 15, wherein said at least one circular surrounding piece is raised along the outer circumference to the central aperture.

18. A method of manufacture as in claim 15, further comprising the step of:

providing a decorative element in communication with said glitter adhesive filled well;

providing at least one circular surrounding piece having a partially hemi-spherical shape with a central aperture formed in the apex and an outer circumference, said central aperture corresponding to and surrounding said decorative element.

19. A method of manufacture as in claim 18, wherein said decorative element is a similar size as said at least one gemstone.

20. A method of manufacture as in claim 18, wherein said decorative element is selected from the group consisting of gemstone, epoxy, adhesive material and cubic zirconium.

21. An article of jewelry as in claim 15, wherein said glitter has a particle size between 0.004 and 0.020 inches, preferably 0.008 inches.

* * * * *